US011779099B2

(12) United States Patent
Bunch

(10) Patent No.: US 11,779,099 B2
(45) Date of Patent: Oct. 10, 2023

(54) FACE MASK CLIP

(71) Applicant: Ian Bunch, Chadds Ford, PA (US)

(72) Inventor: Ian Bunch, Chadds Ford, PA (US)

( * ) Notice: Subject to any disclaimer, the term of this patent is extended or adjusted under 35 U.S.C. 154(b) by 0 days.

(21) Appl. No.: 17/724,591

(22) Filed: Apr. 20, 2022

(65) Prior Publication Data

US 2022/0346535 A1 Nov. 3, 2022

Related U.S. Application Data

(60) Provisional application No. 63/183,246, filed on May 3, 2021.

(51) Int. Cl.
*A45F 5/02* (2006.01)
*A41D 13/11* (2006.01)

(52) U.S. Cl.
CPC ..... *A45F 5/02* (2013.01); *A41D 13/11* (2013.01)

(58) Field of Classification Search
CPC ... A45F 5/02; A44D 2203/00; Y10T 24/2708; Y10T 24/202; Y10T 24/203; Y10T 24/32
See application file for complete search history.

(56) References Cited

U.S. PATENT DOCUMENTS 2,448,611 A * 9/1948 Martin ..... B42D 9/004 116/234
3,529,328 A * 9/1970 Davison ..... D06F 55/00 24/303
4,258,493 A * 3/1981 Kettlestrings ..... G09F 1/10 24/339
5,682,653 A * 11/1997 Berglof ..... G09F 1/10 224/183
2002/0073516 A1* 6/2002 Behar ..... A47B 21/06 24/306
2009/0283197 A1* 11/2009 Gorodisher ..... A45C 13/1069 156/60
2010/0157237 A1* 6/2010 Mor ..... G02C 3/04 351/155

FOREIGN PATENT DOCUMENTS

DE 202020004509 U1 * 12/2020 ..... A45F 5/02

OTHER PUBLICATIONS

English (machine) translation of DE-202020004509-U1, retrieved from USPTO PE2E-SEARCH on Apr. 14, 2023.(5 pages) (Year: 2023).*

* cited by examiner

*Primary Examiner* — Robert Sandy
(74) *Attorney, Agent, or Firm* — Joseph E. Maenner; Maenner & Associates, LLC

(57) ABSTRACT

A face mask clip includes a body having a top portion configured to be attached to clothing, a bottom portion, and a neck portion extending between the top portion and the bottom portion such that the bottom portion is foldable toward the top portion at the neck portion. A connection mechanism includes a first connector portion attached to the top portion of the body and a second connector portion attached to the bottom portion of the body such that the second connector portion is releasably engageable with the top connector portion. A method of using the clip to hold a face mask is also provided.

9 Claims, 4 Drawing Sheets

FACE MASK CLIP

CROSS-REFERENCE TO RELATED APPLICATION

The present application claims priority from U.S. Provisional Application Ser. No. 63/183,246, filed on May 3, 2021, which is incorporated herein by reference in its entirety.

BACKGROUND OF THE INVENTION

Field of the Invention

The invention relates to a clip worn on clothing onto which a personal face mask can be clipped when not in use.

Description of the Related Art

The rise of COVID-19 has prompted many changes in human lifestyle, most notable the wearing of face masks in public. One issue that has arisen is where to put the face mask when not being worn, but still having the face mask be readily accessible to the user when the face mask is required to be worn.

It would be beneficial to provide a retaining device that allows the face mask to be readily accessible when needed.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a clip that is used to retain a face mask on a person's clothing when not in use.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIG. 1 is a front elevational view of an exemplary embodiment of a face mask clip according to the present invention, retaining a face mask there on;

DETAILED DESCRIPTION

Figure 1A:
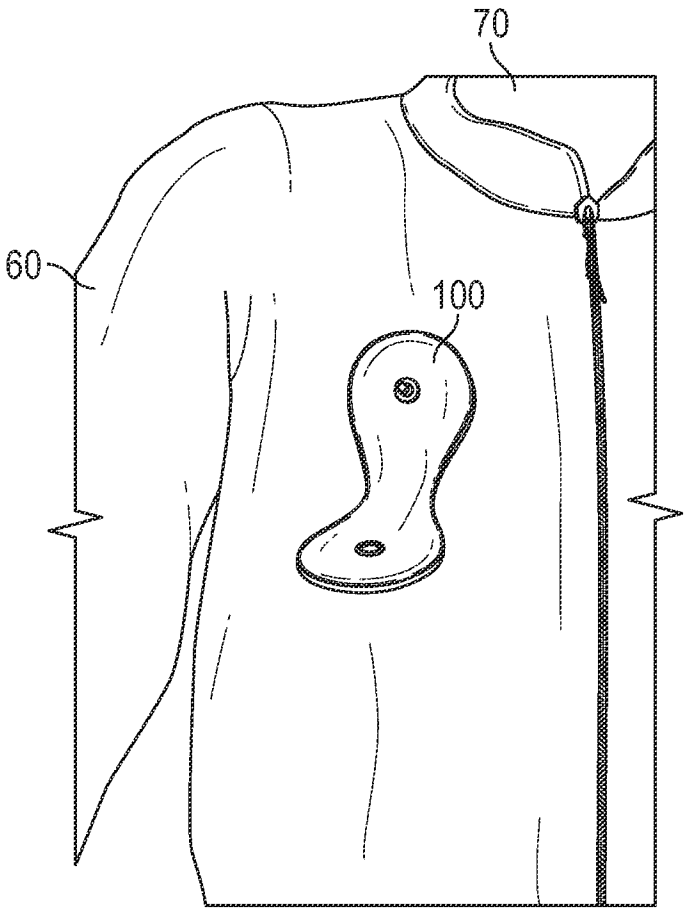
FIG. 1A is a front elevational view of the clip of FIG. 1, without the facemask.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Figure 1:
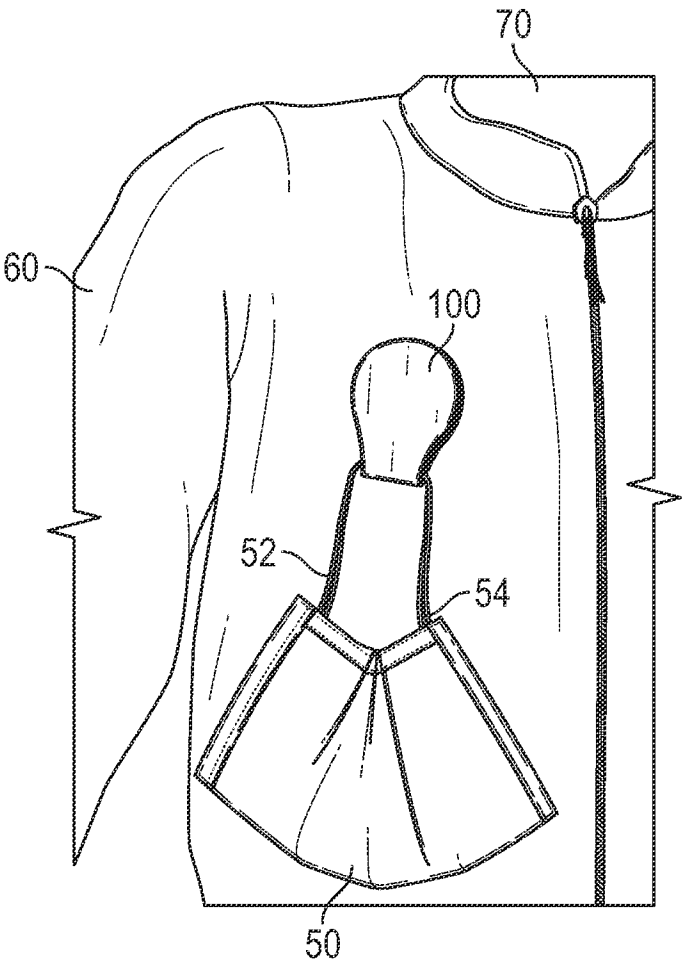

FIG. 1 shows a mask clip 100 ("clip 100") according to an exemplary embodiment of the present invention retaining a face mask 50 having straps 52, 54 onto an article of clothing 60 of a wearer 70. While the clothing 60 shown in a sweatshirt, those skilled in the art will recognize that other types of clothing, such as shirts, sweaters, and the like, can be used to support clip 100 as well. FIG. 1A shows clip 100 when not being used to retain a face mask 50.

Figure 2:
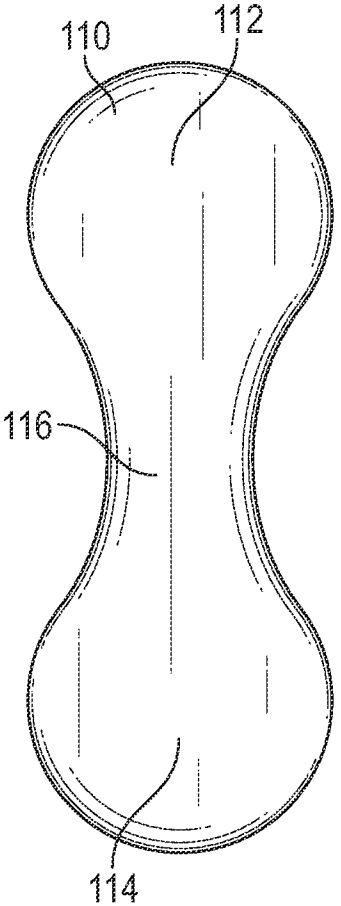
FIG. 2 is a top plan view of the body of the clip of FIG. 1.

Clip 100 is constructed from a body 110, shown in FIG. 2. In an exemplary embodiment, body 110 has a dogbone shape, although those skilled in the art will recognize that other shapes can be used. Body 110 has a top portion 112 that is attached to clothing 60 and a bottom portion 114 that is free from clothing 60. Body 110 also has a narrowed neck portion 116. In a mask securing position, bottom portion 114 is folded upward at neck portion 116 to top portion 112 to secure face mask 50.

Figure 4:
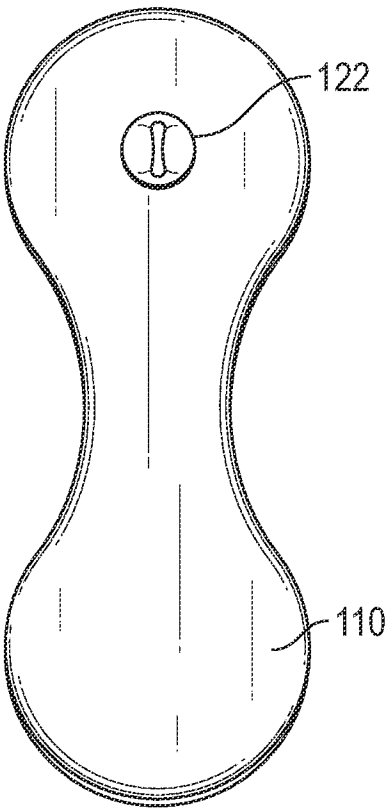
FIG. 4 is a bottom plan view of the clip of FIG. 1 with a second embodiment of a retaining mechanism.
Figure 3:
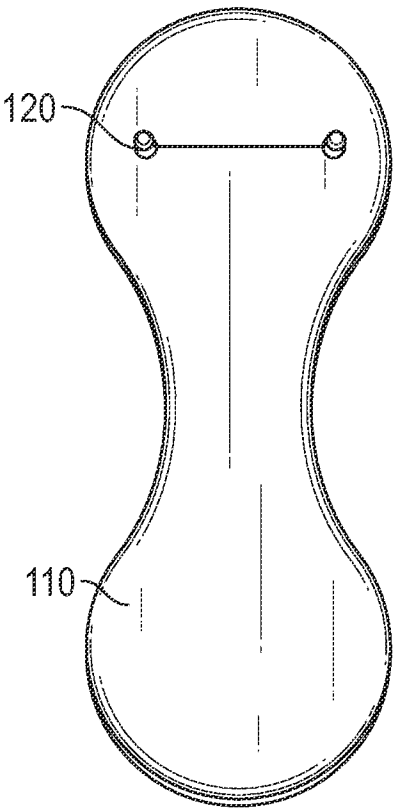
FIG. 3 is a bottom plan view of the clip of FIG. 1 with a first embodiment of a retaining mechanism.
Figure 6:
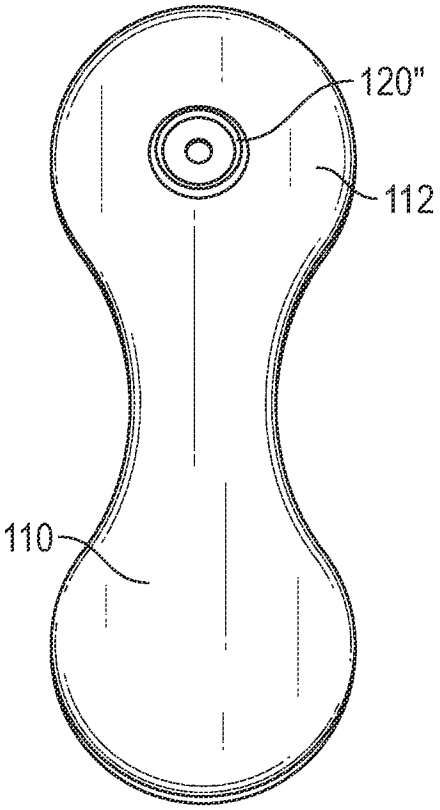
FIG. 6 is a bottom plan view of the clip of FIG. 1 with a third embodiment of a retaining mechanism.
Figure 5:
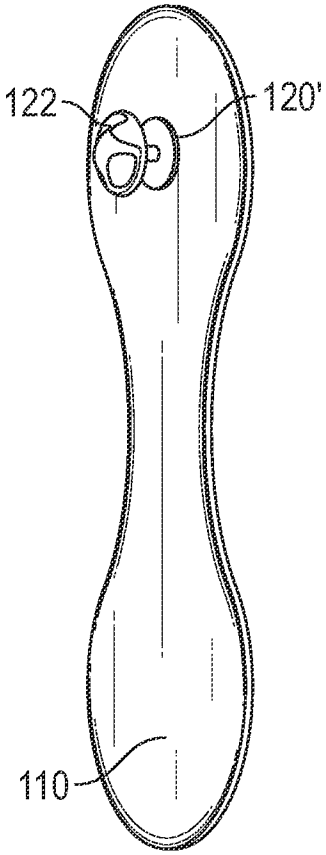
FIG. 5 is a side perspective view of the clip with the retaining mechanism of FIG. 4.

Top portion 112 can be releasably secured to clothing 60 in one of several known retaining mechanisms, such as, for example, by a safety type pin 120, shown in FIG. 3; by a straight pin 120' with a clasp 122, shown in FIGS. 4 and 5 by a magnet 120" that is releasably attachable to a metal plate (not shown) on top portion 112 of body 110, shown in FIG. 6; or other similar type of removable securing method. It is noted that pins 120, 120' must puncture clothing 60 to secure body 110 to clothing 60 and may not be suitable for all types of clothing 60, such as a leather jacket. In such instances, magnet 120" may be preferable.

Also, while several retaining mechanisms are shown and described, those skilled in the art will recognize that clip 100 can be directly sewn or otherwise permanently attached to an article of clothing.

Figure 7:
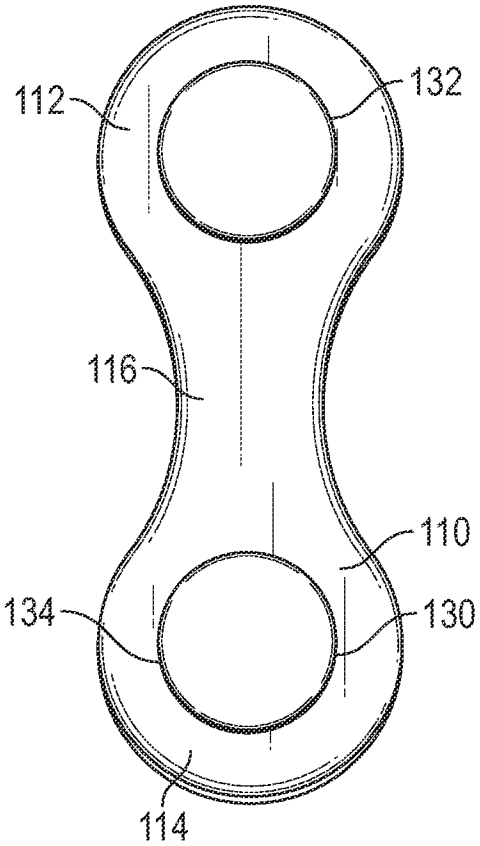
FIG. 7 is a top plan view of the clip of FIG. 1 with a first embodiment of a securing mechanism.

Clip 100 can use one of several connection mechanisms to retain bottom portion 114 to top portion 112. As shown in FIG. 7, one type of fastener 130 can be a hook and loop fastener, with the hook portion 132 attached to the top portion 112 of body 110 and the loop portion 134 attached to the bottom portion 114 of body 110. When body 110 is folded at neck portion 116, hook portion 132 engages with loop portion 134 to secure bottom portion 114 of body 110 to top portion 112 of body 110.

Figure 8:
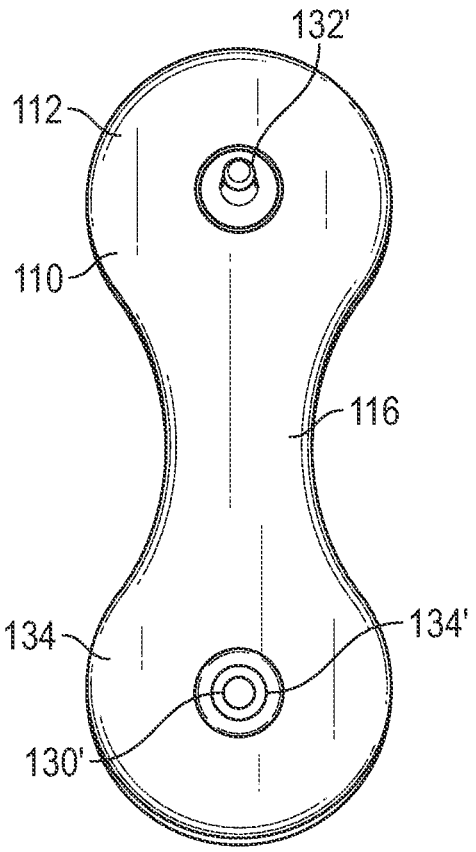
FIG. 8 is a top plan view of the clip of FIG. 1 with a second embodiment of a securing mechanism.

FIG. 8 shows an alternative embodiment of a securing mechanism, using a snap assembly 130'. Snap assembly 130' uses a male snap portion 132' attached to top portion 112 of body 110 and a female snap portion 134' attached to bottom portion 114 of body 110. When body 110 is folded at neck portion 116, male snap portion 132' is inserted into female snap portion 134' to secure bottom portion 114 of body 110 to top portion 112 of body 110.

Figure 9:
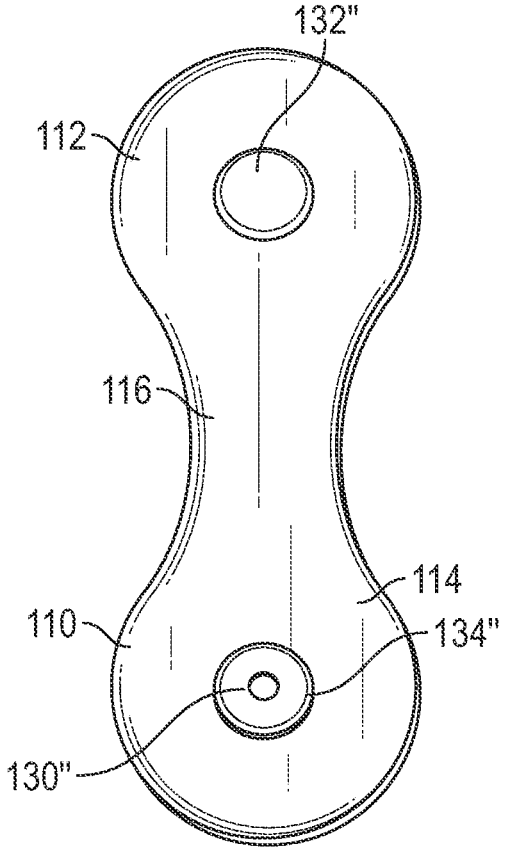
FIG. 9 is a top plan view of the clip of FIG. 1 with a third embodiment of a securing mechanism.

FIG. 9 shows another alternative embodiment of a securing mechanism, using a magnet assembly 130". Magnet assembly 130" uses a magnetic portion 132" attached to top portion 112 of body 110 and a magnetically attractive portion 134" attached to bottom portion 114 of body 110. When body 110 is folded at neck portion 116, magnetic portion 132" is magnetically attached to magnetically attractive portion 134" to secure bottom portion 114 of body 110 to top portion 112 of body 110.

Clip 100 can be used keep to mask 50 off surfaces (e.g., tables, counters, desks, dashboards) and out of pockets while not in use ad is much more hygienic for mask effectivity. Further, it is believed that the use of clip 100 increases the lifespan of mask 50, reducing waste.

To use clip 100, clip 100 is attached to clothing 60 as shown in FIG. 1A. A face mask 50 having straps 52, 54 is closed so that straps 52, 54 form a loop with face mask 50. The top part of the loop is placed against neck portion 116 and bottom portion 114 of body 110 is folded upwardly at neck portion 116 until bottom portion 114 engages top portion 112 and loop portion 134 is attached to hook portion 132; female snap portion 134' is engaged with male snap portion 132'; or magnetically attractive portion 134" is engaged with magnetic portion 134", thereby securing the straps 52, 54 in clip 100.

To remove face mask 50 from clip, loop portion 134 is separated from hook portion 132; female snap portion 134' is separated from male snap portion 132'; or magnetically attractive portion 134" is separated from magnetic portion 134". Bottom portion 114 is disengaged from top portion 112 of body 110 and face mask 50 is removed from clothing 60.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A face mask clip comprising:

a body having:

a top portion configured to be attached to an article of clothing;

a bottom portion;

a neck portion extending between the top portion and the bottom portion such that the bottom portion is foldable toward the top portion at the neck portion; and a connection mechanism comprising:

a first connector portion attached to the top portion of the body; and a second connector portion attached to the bottom portion of the body such that the second connector portion is releasably engageable with the first connector portion, wherein the connection mechanism is one from the group consisting of a hook and loop fastener, a snap assembly, a pin attached to the top portion wherein the pin is used to secure the body to the article of clothing, and a magnet attached to the top portion wherein the magnet is used to secure the body to the article of clothing.

2. The face mask clip according to claim 1, wherein the body has a dog bone shape.

3. The face mask clip according to claim 1, wherein the neck portion is narrower than the bottom portion.

4. A method of supporting a face mask comprising the steps of:

(a) providing the clip according to claim 1 on an article of clothing;

(b) placing a strap of a face mask proximate to the neck portion of the body;

(c) folding the bottom portion of the body upward toward the top portion of the body; and (d) connecting the first connector portion to the second connector portion.

5. The method according to claim 4, wherein step (b) comprises placing two straps of the face mask proximate to the neck portion of the body.

6. The method according to claim 4, further comprising the step of:

(e) disconnecting the first connector portion from the second connector portion; and (f) removing the mask from the clip.

7. A face mask clip comprising:

a body having:

a top portion configured to be attached to an article of clothing;

a bottom portion foldable toward the top portion; and a connection mechanism comprising:

a first connector portion attached to the top portion of the body; and a second connector portion attached to the bottom portion of the body such that the second connector portion is releasably engageable with the first connector portion, wherein the top portion is configured to be sewn to the article of clothing.

8. The face mask clip according to claim 7, further comprising a neck portion between the top portion and the bottom portion, the neck portion being narrower than each of the top portion and the bottom portion.

9. A face mask clip comprising:

a body having:

a top portion configured to be attached to an article of clothing;

a bottom portion foldable toward the top portion; and a connection mechanism comprising:

a first connector portion attached to the top portion of the body; and a second connector portion attached to the bottom portion of the body such that the second connector portion is releasably engageable with the first connector portion, wherein the top portion is configured to be releasably attached to the article of clothing.

* * * * *